US010879582B1

(12) United States Patent
Loeb

(10) Patent No.: US 10,879,582 B1
(45) Date of Patent: Dec. 29, 2020

(54) DIELECTRIC REINFORCED FORMED METAL ANTENNA

(71) Applicant: Rockwell Collins, Inc., Cedar Rapids, IA (US)

(72) Inventor: Logan A. Loeb, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 16/537,776

(22) Filed: Aug. 12, 2019

(51) Int. Cl.

| | |
|---|---|
| ***H01Q 21/00*** | (2006.01) |
| ***H01Q 21/06*** | (2006.01) |
| ***H01Q 1/22*** | (2006.01) |
| ***H01Q 1/38*** | (2006.01) |
| ***H01Q 9/16*** | (2006.01) |

(52) U.S. Cl.
CPC ..... *H01Q 1/2283* (2013.01); *H01Q 1/38* (2013.01); *H01Q 9/16* (2013.01); *H01Q 21/0025* (2013.01); *H01Q 21/061* (2013.01)

(58) Field of Classification Search
CPC ..... H01Q 21/064; H01Q 13/085; H01Q 21/0087; H01Q 13/10; H01Q 21/061; H01Q 1/38; H01Q 5/25; H01Q 5/42; H01Q 9/0421; H01Q 1/2283; H01Q 21/0025; H01Q 9/16
See application file for complete search history.

(56) References Cited

U.S. PATENT DOCUMENTS

| | | | | |
|---|---|---|---|---|
| 5,786,792 | A * | 7/1998 | Bellus | H01Q 13/085 343/767 |
| 6,891,511 | B1 * | 5/2005 | Angelucci | H01Q 13/08 343/767 |
| 8,138,985 | B2 * | 3/2012 | Cooper | H01Q 13/085 343/770 |
| 8,983,618 | B2 | 3/2015 | Yamamoto et al. | |
| 9,325,075 | B1 * | 4/2016 | Lam | H01Q 13/085 |
| 9,780,458 | B2 * | 10/2017 | Viscarra | H01Q 1/526 |
| 10,230,172 | B1 * | 3/2019 | Wolf | H01Q 21/064 |
| 10,361,485 | B2 * | 7/2019 | Isom | H01Q 21/065 |
| 10,665,957 | B1 * | 5/2020 | Seller | H01Q 21/0087 |
| 2013/0220548 | A1 | 8/2013 | Setsuhara et al. | |

* cited by examiner

*Primary Examiner* — Vibol Tan
(74) *Attorney, Agent, or Firm* — Suiter Swantz pc llo

(57) ABSTRACT

A device and method of fabrication of a dielectrically reinforced formed metal antenna element enables an easily replaceable antenna element unlimited by PCB thickness constraints and planar structures. Modern fabrication methods are employed to embed pre-formed metal antenna structures in a rigid dielectric material. Conductive elastomer contacts provide electrical contact between an RF distribution PCB and the antenna element structures. A single layer of the dielectrically reinforced formed metal antenna elements may offer a simple yet effective antenna element capable of excellent RF connectivity up to 20 GHz. The individual elements are conformal to an installation, cooperative with additional elements, and easily replaceable with molded couplings attachable to the PCB with the flexible elastomers ensuring connectivity.

15 Claims, 11 Drawing Sheets

DIELECTRIC REINFORCED FORMED METAL ANTENNA

BACKGROUND

One traditional approach to fabricating low-cost antenna arrays is to print them directly on Flame Retardant (FR)-4 or similar Printed Circuit Board (PCB)s. While this approach may be cost effective, it has several limitations, especially for designs below 1 GHz.

Maximum PCB thickness of approximately 0.2 inches is a small fraction of a wavelength at low frequencies under 1 GHz. As frequencies may decrease, PCB thickness must increase to maintain a similar bandwidth capability. In many cases, a too thin PCB may result in narrow impedance bandwidth and reduced radiation efficiency. With increased bandwidth desire, many antenna elements may be physically limited by a height of the PCB and antenna.

To overcome some of these limits, traditional elements may attempt to increase RF power output and efficiency by adding additional layers of elements, adding active devices, and powered layers. These options may increase some performance, but add considerable cost to the overall antenna structure.

Traditionally, antenna elements may be soldered onto or solidly connected to the PCB creating a rigid structure inflexible to conformity to an installation. Antenna designs integrated with the PCB metal are difficult to change without a redesign of the entire structure. Card-based antenna arrays may achieve larger bandwidths than planar, printed designs but require connectors that may greatly increase cost when multiplied by many array elements.

Therefore, a need remains for a system and related method which may overcome these limitations and provide a novel solution to bandwidth limits at lower frequencies by implementing a dielectrically reinforced formed metal antenna element capable of a great frequency range offering extended bandwidth unlimited by geometry and easily interchangeable.

SUMMARY

In one aspect, embodiments of the inventive concepts disclosed herein are directed to a dielectrically reinforced formed metal antenna element. The antenna element may comprise a formed metal antenna element electrically connectable with a printed circuit board (PCB), the formed metal antenna element having a radiating element at a radiating end of the formed metal antenna element and a connection element at a connection end of the formed metal antenna element, the formed metal antenna element maintaining a height above the PCB enabling a transmission and a reception of a bandwidth over a specific frequency range.

The formed metal element may be substantially surrounded by a dielectric material surrounding a substantial portion of the formed metal antenna element allowing the connection element to remain exposed, the dielectric material including a cavity situated in a center section of the dielectric material proximal with the formed metal antenna element, the cavity open to and extending to a coupling end of the dielectrically reinforced formed metal antenna element proximal with the connection end of the formed metal antenna element.

The dielectrically reinforced formed metal antenna element may include a mechanical couple affixed to the dielectric material proximal with the PCB, the mechanical couple configured to removably couple the dielectrically reinforced formed metal antenna element to the PCB For flexible connectivity, the dielectrically reinforced formed metal antenna element may include a conductive elastomer coupled with the PCB, the conductive elastomer aligned with and configured to electrically couple the connection element of the formed metal antenna element to the PCB, the conductive elastomer flexible and configured to separate the dielectric material from the PCB creating a flexible gap between the dielectric material and the PCB.

A further embodiment of the inventive concepts disclosed herein may include a method for fabricating a dielectrically reinforced formed metal antenna element. The method may include machining a formed metal antenna element, the formed metal antenna element having a radiating element and a connection element and molding a dielectric material substantially surrounding the formed metal antenna element, the molding leaving the connection element exposed. The method may include molding a mechanical coupling in at least two locations on a connection end of the dielectric material, the mechanical coupling configured to removably couple the dielectrically reinforced formed metal antenna element to a PCB.

The method may further include coupling a flexible conductor to the PCB, the flexible conductor aligning with the connection element of the formed metal antenna element, and coupling a dielectrically reinforced formed metal antenna element to the PCB.

It is to be understood that both the foregoing general description and the following detailed description are exemplary and explanatory only and are not necessarily restrictive of the inventive concepts as claimed. The accompanying drawings, which are incorporated in and constitute a part of the specification, illustrate embodiments of the inventive concepts and together with the general description, serve to explain the principles of the inventive concepts disclosed herein.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings in which.

DETAILED DESCRIPTION OF EXEMPLARY EMBODIMENTS

Figure 1:
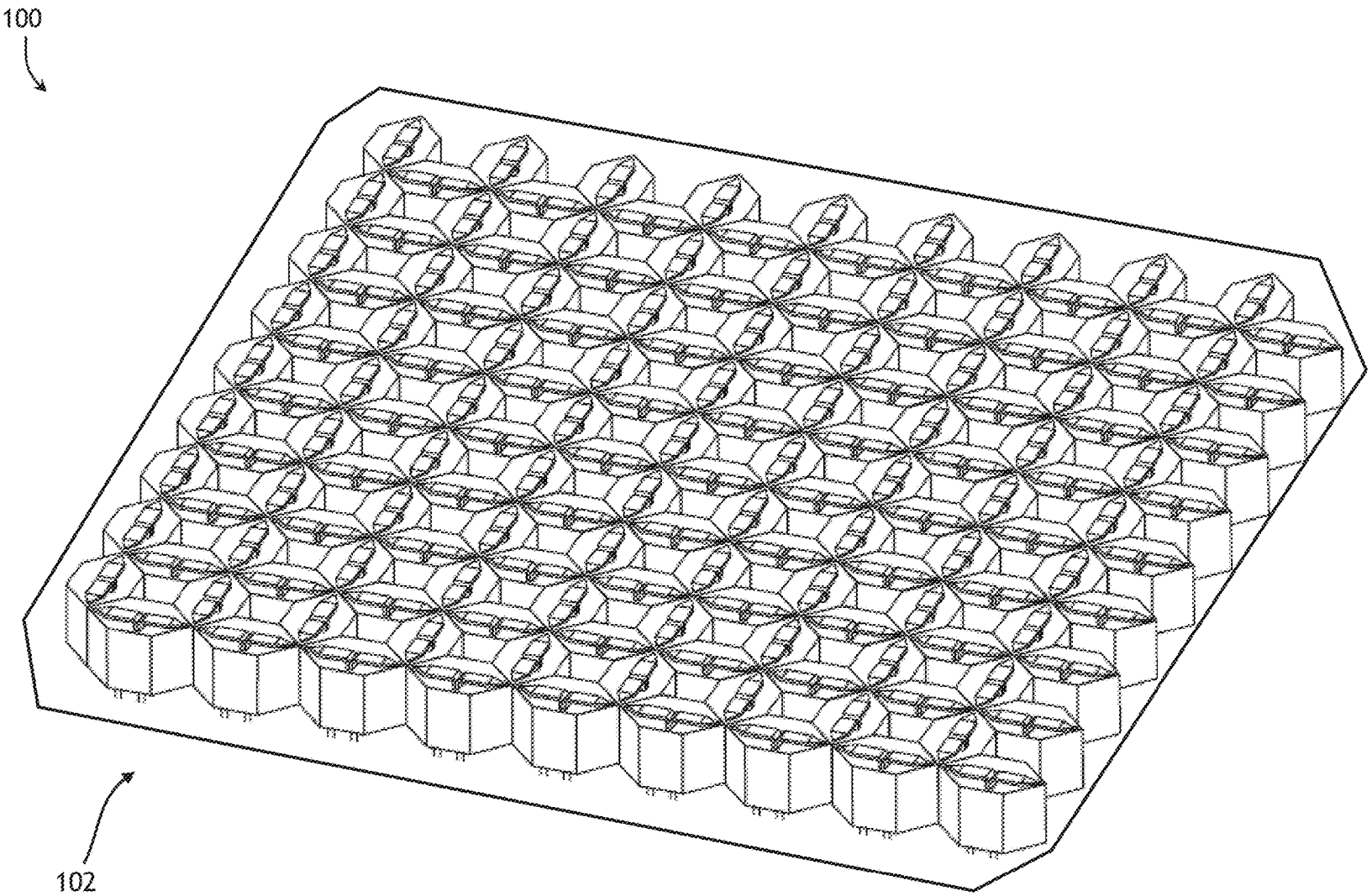
FIG. 1 is a diagram of an antenna array in accordance with an embodiment of the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, thus "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Overview

Broadly, embodiments of the inventive concepts disclosed herein are directed to a device and method of fabrication of a dielectrically reinforced formed metal antenna element enables an easily replaceable antenna element unlimited by PCB thickness constraints and planar structures. Modern fabrication methods are employed to embed pre-formed metal antenna structures in a rigid dielectric material. Conductive elastomer contacts provide electrical contact between an RF distribution PCB and the antenna element structures. A single layer of the dielectrically reinforced formed metal antenna elements may offer a simple yet effective antenna element capable of excellent RF connectivity up to 20 GHz. The individual elements are conformal to an installation, cooperative with additional elements, and easily replaceable with molded couplings attachable to the PCB with the flexible elastomers ensuring connectivity

REFERENCE CHART

| | |
|---|---|
| 100 | Large View of Antenna Array |
| 102 | Antenna Array |
| 104 | Element Cluster |
| 110 | Dielectrically Reinforced Formed Metal Antenna Element |
| 112 | Mechanical Couple |
| 114 | Left Radiating Element |
| 116 | Right Radiating Element |
| 124 | Left Vertical Element |
| 126 | Right Vertical Element |
| 134 | Left Connection Element |
| 136 | Right Connection Element |
| 200 | View of Coupled Elements |
| 210 | Dielectric Material |
| 212 | Cavity |
| 214 | Airflow |
| 216 | Coupling End |
| 300 | View of Individual Antenna Element |
| 334 | Left Conductive Elastomer |
| 336 | Right Conductive Elastomer |
| 344 | Left PCB Via |
| 346 | Right PCB Via |
| 350 | PCB |
| 352 | PCB Backplane |
| 354 | Left PCB Transmission Line |
| 356 | Right PCB Transmission Line |
| 360 | PCB Thickness |
| 400 | Internal View of Antenna |
| 410 | Formed Metal Antenna Element |
| 412 | PCB Mechanical Coupling Orifice |
| 414 | Radiating End |
| 416 | Connection End |
| 430 | Bending Point |
| 500 | Single Element View |
| 504 | Left Horn |
| 510 | Radiating Element Thickness |
| 514 | Upper 90 |
| 524 | Lower 90 |
| 600 | Dielectric Material View |
| 700 | Internal View |

-continued

| REFERENCE CHART | |
|---|---|
| 710 | Width of Element |
| 712 | Height of Element |
| 714 | Height of Gap |
| 716 | Depth of Element |
| 718 | Depth of Metal Elements |
| 800 | Front View |
| 850 | Flexible Gap |
| 900 | Side View |
| 1000 | Top View |
| 1100 | Method Flow |

FIG. 1

Referring now to FIG. 1, a diagram of an antenna array in accordance with an embodiment of the inventive concepts disclosed herein is shown. Generally, a large view 100 of an antenna array 102 may be comprised of a plurality of individual elements. In embodiments, the array 102 may be flexible and conformal (e.g., hemispheric) to a site of desired employment. The array 102 may function as a directional antenna offering flexibility to a user to employ the array 102 for directional RF communication, for example, between surface ships and vehicles.

FIG. 2

Figure 2:
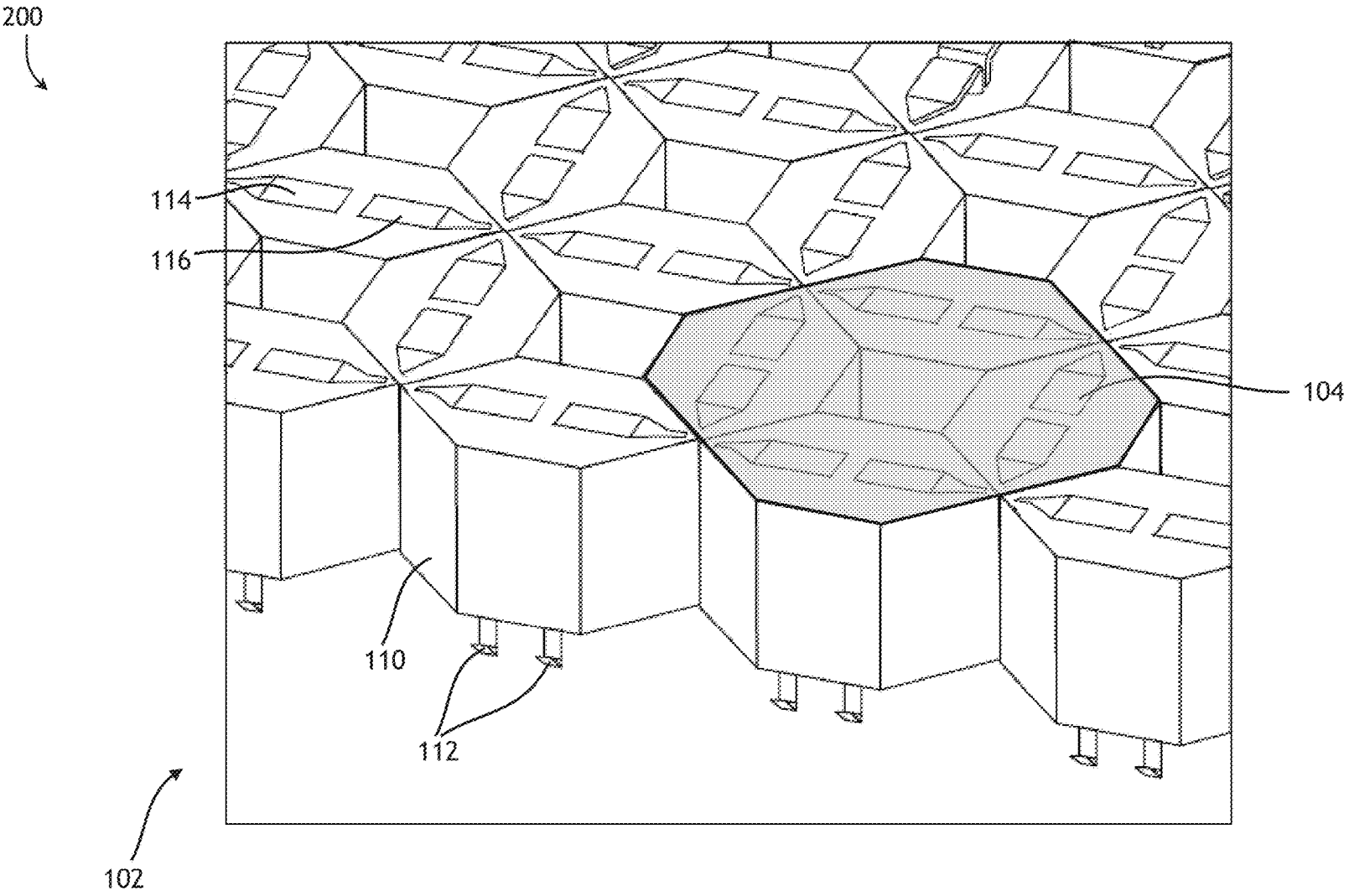
FIG. 2 is a diagram of coupled antenna elements in accordance with an embodiment of the inventive concepts disclosed herein.

Referring now to FIG. 2, a diagram of coupled antenna elements in accordance with an embodiment of the inventive concepts disclosed herein is shown. The antenna array 102 may be comprised of a plurality of individual a dielectrically reinforced formed metal antenna element 110 shaped specifically to coordinate with other similarly shaped elements to form the array 102. The array 102 may be a single dielectrically reinforced formed metal antenna element 110 couplable to a PCB via one or more mechanical couples 112. An element cluster 104 of the dielectrically reinforced formed metal antenna elements 110 may comprise a building block of the larger array 102. Oriented together, each individual dielectrically reinforced formed metal antenna element 110 of the element cluster 104 may maintain a shape enabling four of the dielectrically reinforced formed metal antenna elements to meet at a 90-degree angle to form an octagonal outer perimeter parallel to the PCB.

FIG. 3

Figure 3:
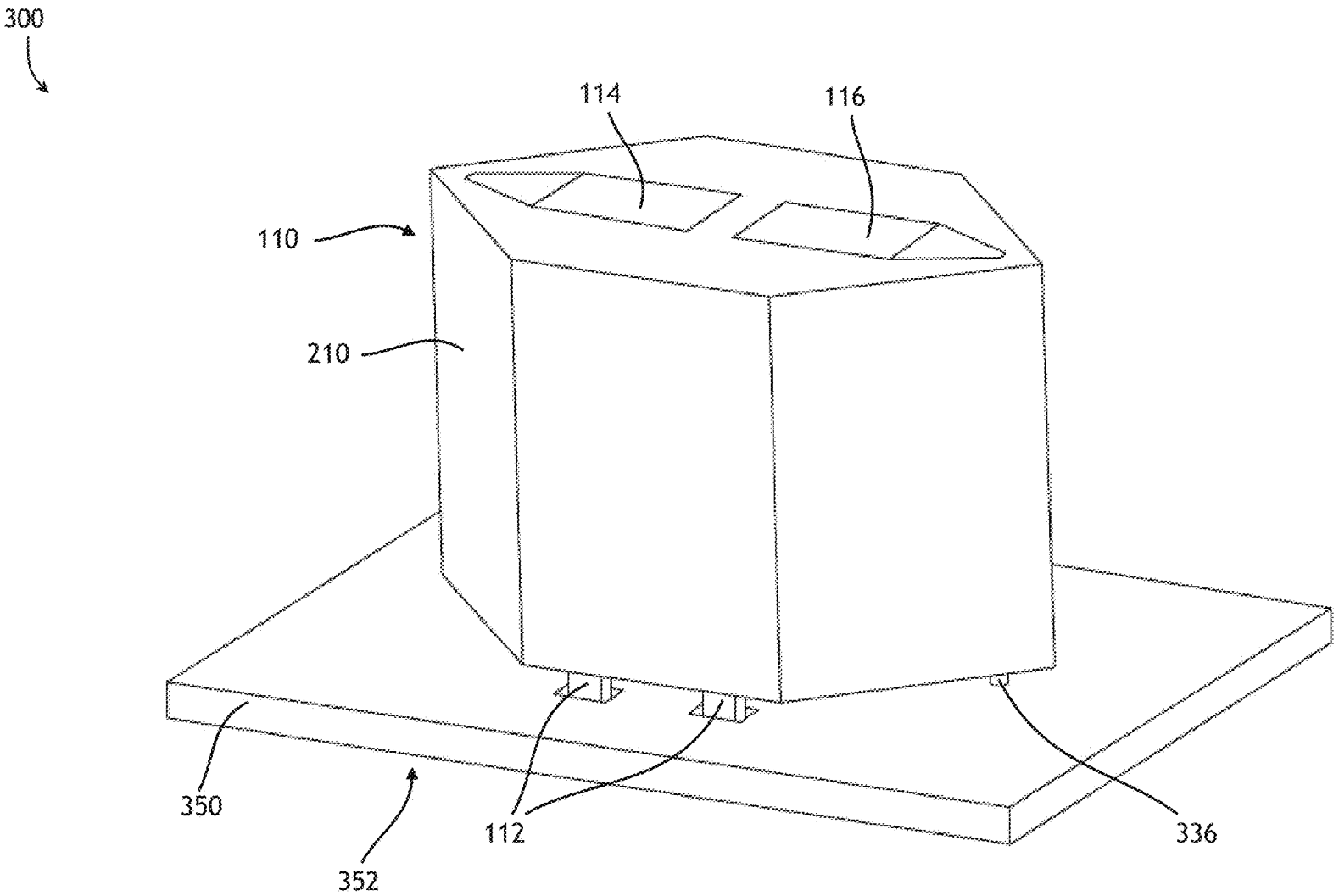
FIG. 3 is a diagram of an individual dielectrically reinforced formed metal antenna element exemplary of an embodiment of the inventive concepts disclosed herein.

Referring now to FIG. 3, a diagram of an individual dielectrically reinforced formed metal antenna element exemplary of an embodiment of the inventive concepts disclosed herein is shown. The individual dielectrically reinforced formed metal antenna element 110 may include the mechanical couples 112 coupled here to a PCB 350, a left radiating element 114, a right radiating element 116, and also shown in this view, a right conductive elastomer 336.

As goals of the inventive concepts disclosed herein may include low cost, simplicity of manufacture, and ease of interchangeability, the individual dielectrically reinforced formed metal antenna element may be efficiently fabricated and easily interchangeable on the PCB 350. As one individual element 110 may become inoperative due to breakage or wear, a user may simply remove the inoperative element 110 and replace it with an operative element 110.

Each of the dielectrically reinforced formed metal antenna elements 110 may be substantially surrounded by a dielectric material 210. As can be seen here, an outer hexagonal shape of the dielectric material 210 may allow multiple individual dielectrically reinforced formed metal antenna elements 110 to meet at the 90-degree angle and symmetrically orient to form the array 102.

FIG. 4

Figure 4:
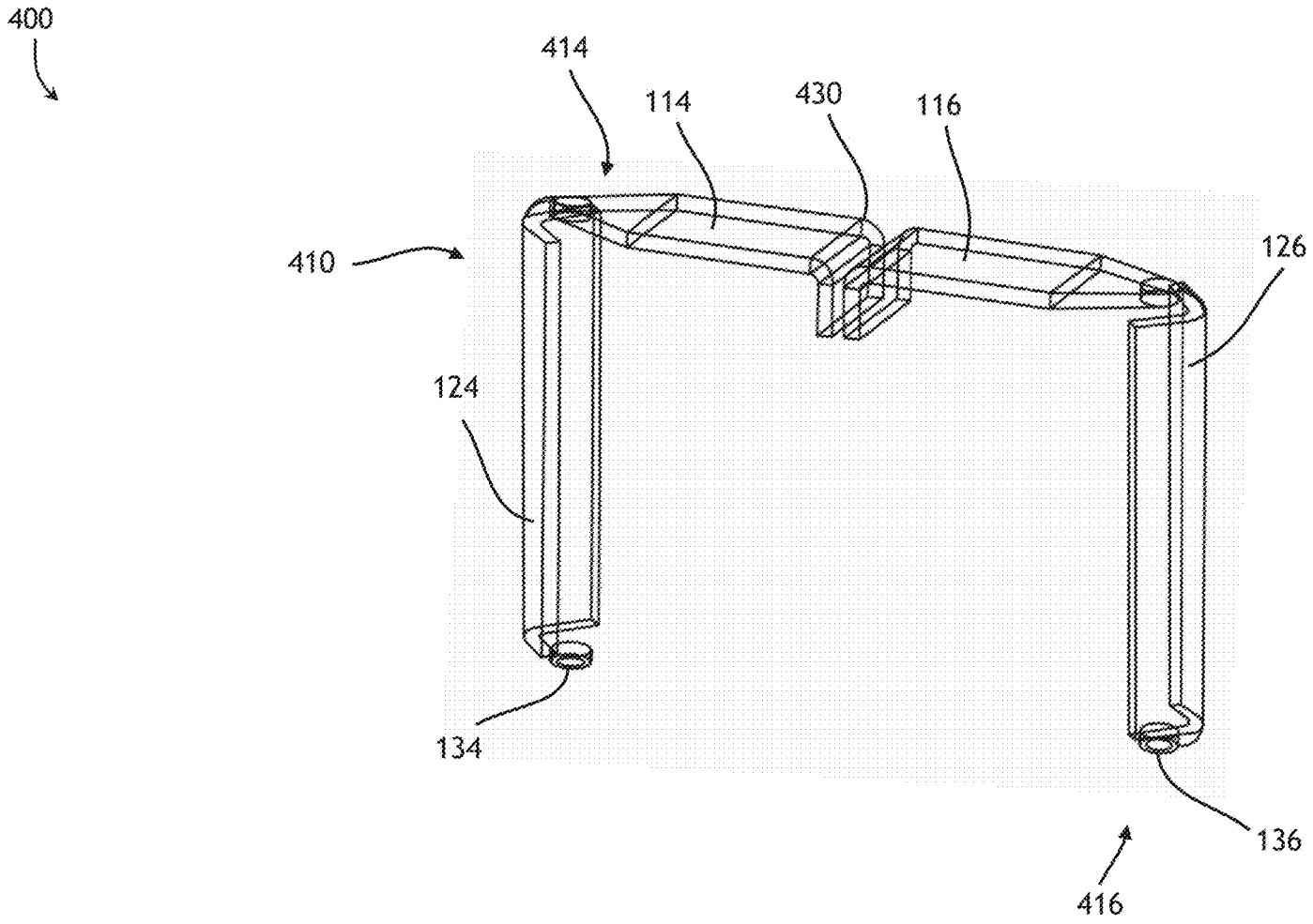
FIG. 4 is a view of a formed metal antenna element exemplary of one embodiment of the inventive concepts disclosed herein.

Referring now to FIG. 4, a view of a formed metal antenna element exemplary of one embodiment of the inventive concepts disclosed herein is shown. The formed metal antenna element 410 may comprise a plurality of shapes and sizes including an exemplary L-shaped dipole pair of equal and opposite metal antenna elements as shown electrically coupled with the PCB 350. Shown here, a dipole antenna may function within the scope of the concepts disclosed herein while additional types of antennas including a patch antenna may be well suited for this fabrication method. Specifically, a wire-based antenna (e.g., conical) which may not possess the strength to stand on its own yet have the height to perform at a specific level may be within the scope of the inventive concepts disclosed herein. Once embedded within the dielectric material 210, the wire antenna maintains the desired shape.

Additional shapes may include a wire mesh, a single wire, and a circular shaped wire. In additional embodiments, a single, a dual, a quad and a plurality of formed metal antenna element 410 may function well within the scope of the inventive concepts disclosed herein. The formed metal antenna element may create a path for Radio Frequency (RF) energy between the PCB 350 and a radiating elements including the exemplary left radiating element 114 and the right radiating element 116.

To receive and conduct the RF energy the formed metal antenna element 410 may include a left connection element 134 and a right connection element 136, and a left vertical element 124 and a right vertical element 126. The formed metal antenna element 410 may maintain a radiating end 414 comprised of the radiating elements 114 116, and a connection end 416 comprised of the connection elements 134 136.

FIG. 5

Figure 5:
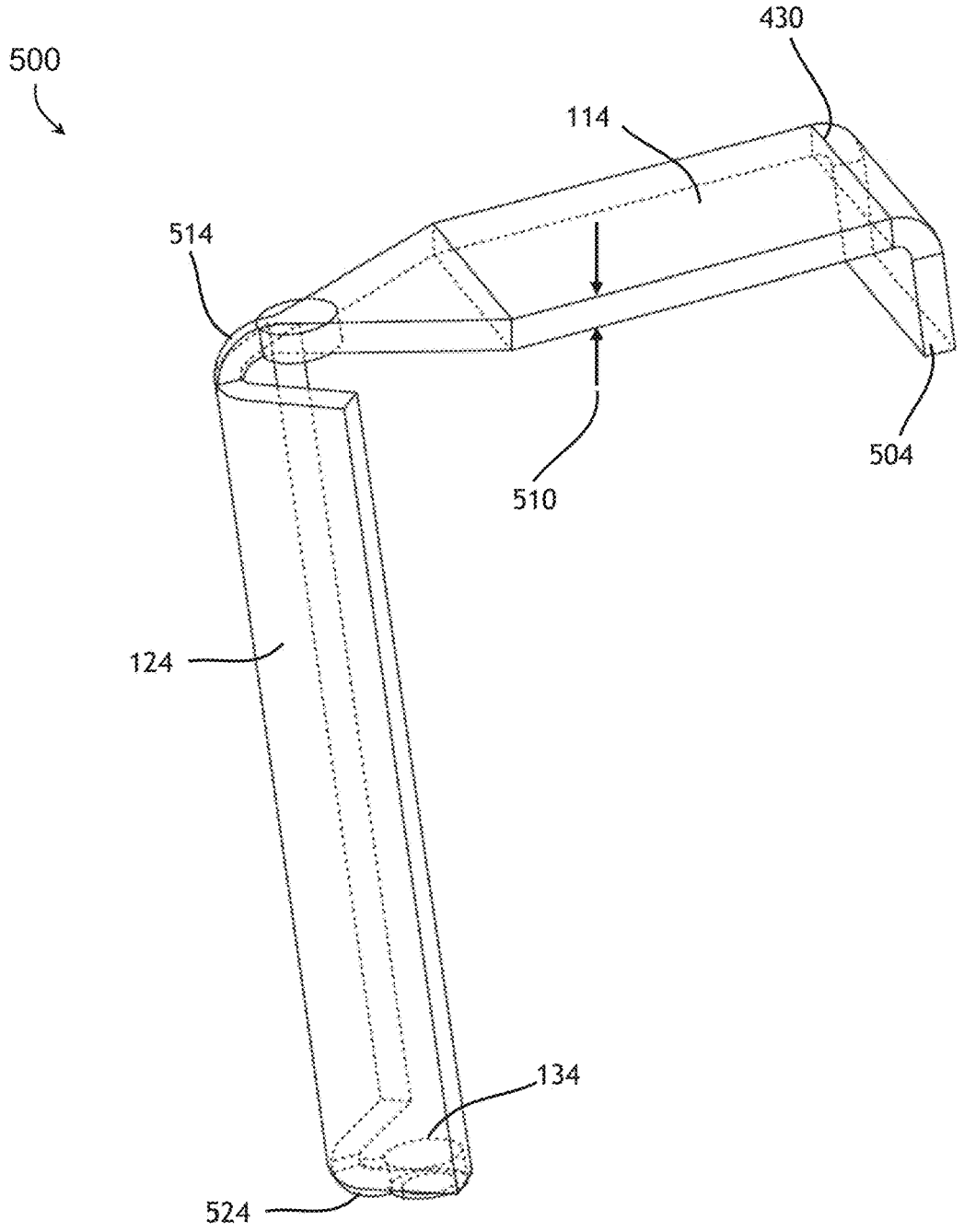
FIG. 5 is a diagram of an individual left metal element of the formed metal antenna element in accordance with one embodiment of the inventive concepts disclosed herein.

Referring now to FIG. 5, a diagram of an individual left metal element of the formed metal antenna element in accordance with one embodiment of the inventive concepts disclosed herein is shown. Shown here, a single element view 500 may indicate details of the left antenna element including, in addition to the above-mentioned elements, the left horn 504, the left upper 90 514, and the left lower 90 524. Each element in the RF pathway may be constructed of similar or divergent conductive material depending on desired performance. The formed metal antenna element 410 may also include ceramics and other non-conductive materials. In one embodiment of the inventive concepts disclosed herein, the formed metal antenna element 410 may be comprised of a copper alloy, a beryllium copper, a stainless steel, an aluminum, a nickel, a nickel alloy, a silver, and a spring steel.

In machining or micro-machining, the formed metal antenna element 410 may be photo etched at a bending line enabling a precise dimension. A specific dimension may include a thickness 510 of the left radiating element 114 of an exemplary 0.05 inches.

FIG. 6

Figure 6:
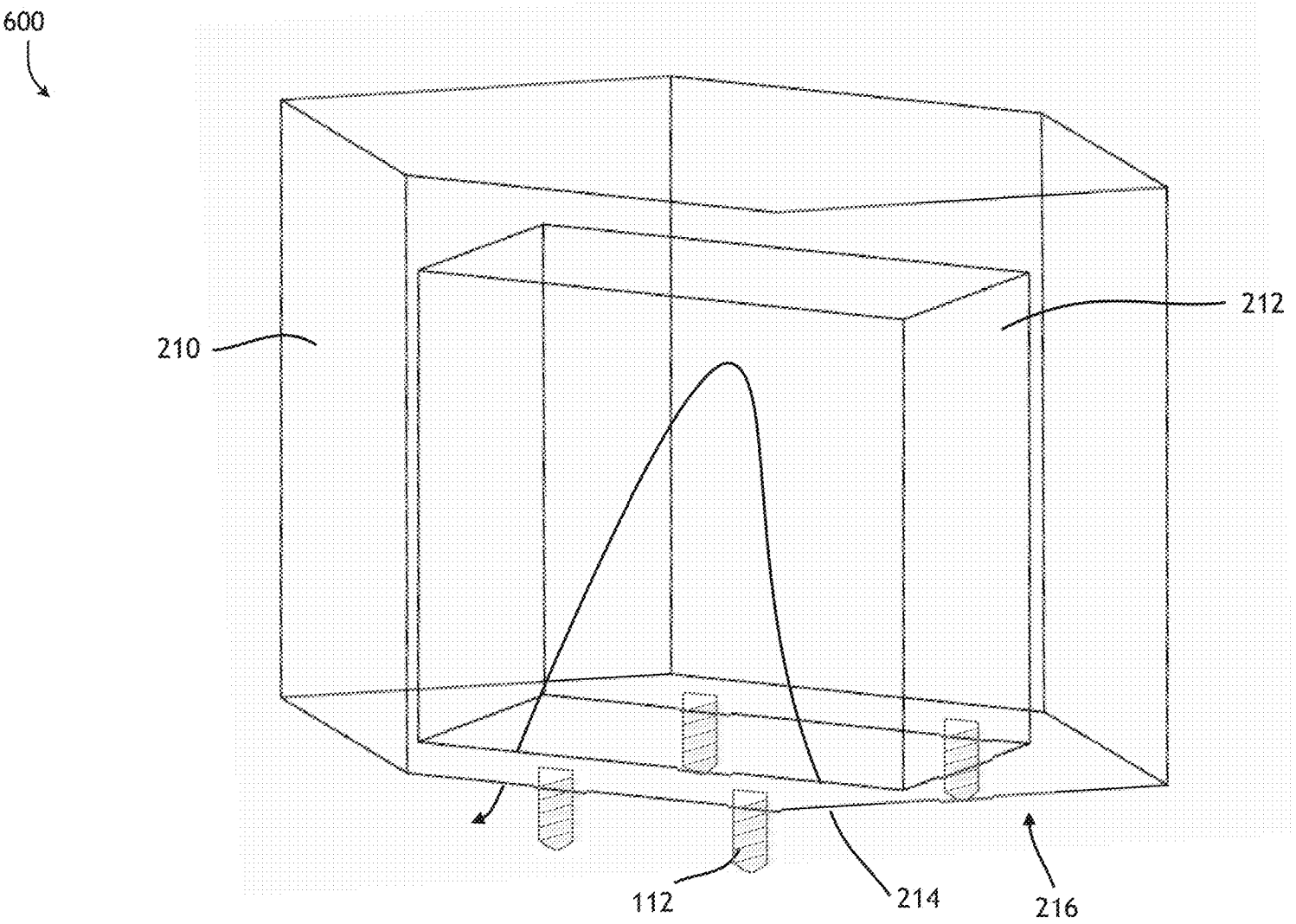
FIG. 6 is a diagram of a dielectric material in accordance with one embodiment of the inventive concepts disclosed herein.

Referring now to FIG. 6, a diagram of a dielectric material in accordance with one embodiment of the inventive concepts disclosed herein is shown. A transparent view 600 of the dielectric material 210 may indicate one exemplary columnar hexagonal shape of the dielectric material 210. In function, the dielectric material 210 may function to support and enable a shape integrity of the formed metal antenna element 410 enabling the dielectrically reinforced formed metal antenna element to efficiently and accurately radiate and receive RF energy. An additional function of the dielectric material 210 may include an outer shape enabling efficient placement and cooperation with additional elements 110 when coupled with the PCB 350.

In one embodiment of the inventive concepts disclosed herein, the hexagonal shape of the dielectric material 210 may promote columnar jointing enabling a plurality of elements to be coupled to the PCB 350. As shown in FIG. 2, four elements in a square pattern may produce an octagonal outer shape of the element cluster 104. Additional exemplary shapes may promote columnar jointing where each individual element is proximal with another leaving no open space on the PCB 350. In one embodiment of the inventive concepts disclosed herein, the dielectric material may be cubic as well as triangular as a user may desire to create a specific arrangement of individual dielectrically reinforced formed metal antenna elements on the PCB 350.

In fabrication, the dielectric material 210 may be injection molded as well as 3D printed for efficient and low-cost fabrication surrounding a majority of the formed metal antenna element 410. In one embodiment of the inventive concepts disclosed herein, the dielectric material 210 may surround a substantial portion of the formed metal antenna element 410 allowing a radiating element 114 116 at a radiating end 414 of the formed metal antenna element 410 and a connection element 134 136 at a connection end 416 of the formed metal antenna element 410 to remain exposed.

In embodiments, the dielectric material 210 may be 3D printed as well as injection molded to conform around the formed metal antenna element 410 as well as support the formed metal antenna element 410. The dielectric material 210 may be fabricated of materials with a range of dielectric constants and loss tangents for tailored RF performance suitable for ease of manufacture, and rigidity to support the formed metal antenna element 410. In one embodiment of the inventive concepts disclosed herein, the dielectric material 210 may be comprised of a plastic, a ceramic, and a ceramic filled plastic.

The dielectric material 210 may substantially cover the formed metal antenna element 410. In one embodiment, the connection element 134 is exposed. In another embodiment, each of the connection element 134 and the radiating element 114 may remain exposed.

In one embodiment of the inventive concepts disclosed herein, the dielectric material 210 may include a cavity 212 situated in a center section of the dielectric material 210 between the formed metal antenna element 410. The cavity 212 may be open to and extending to a coupling end 216 of the dielectrically reinforced formed metal antenna element 110. In one embodiment of the inventive concepts disclosed herein, the cavity 212 may function to remove some of the dielectric material 210 for antenna tuning and to improve performance such as radiation efficiency and bandwidth. Here, the coupling end 216 of the dielectric material 210 may be proximal with the connection end 416 of the formed metal antenna element 410.

To assist in accurate fabrication of the dielectric material 210 without disturbing the shape of the formed metal antenna element 410, one or more retention structures may be incorporated into the dielectric material 210 to ensure antenna shape integrity. For example, an insulated stiffening device may be attached from the left horn 504 to the left connection element 134 to maintain the shape of the L shaped elements as the dielectric material 210 is applied.

The mechanical couples 112 may be employed in one or more shapes and functional embodiments as well. Here, one exemplary mechanical couple may include a threaded bolt incorporated within and fabricated of the same material as the dielectric material 210. Another exemplary mechanical couple 112 may include an adhesive, a hook and loop connection, and additional materials. Contemplated herein, the corresponding PCB 350 may incorporate aligned holes for ease of bolt insertion and the dielectrically reinforced formed metal antenna element 110 may be secured with a nut on the backside of the PCB 350.

FIG. 7

Figure 7:
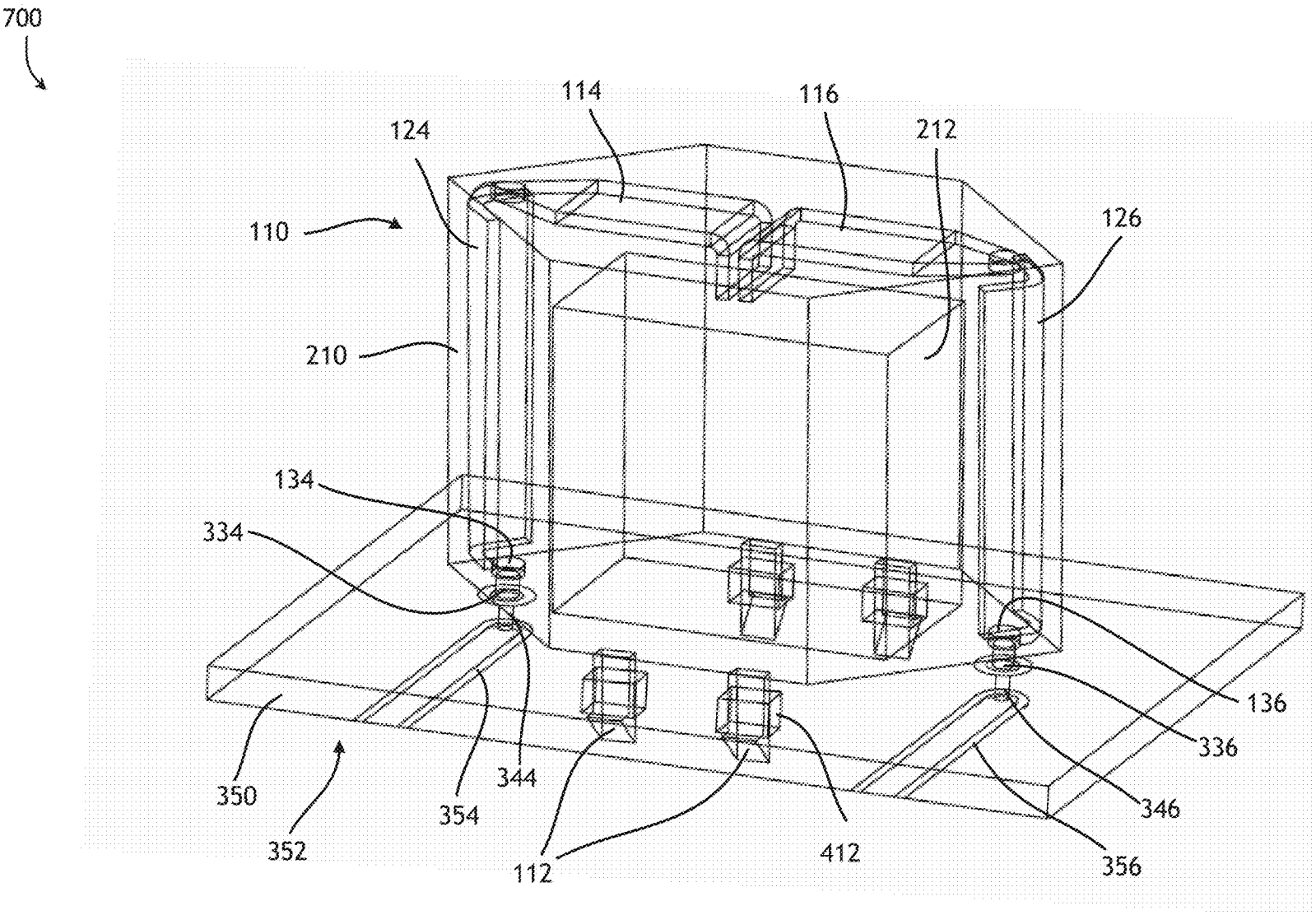
FIG. 7 a diagram of internal components of a dielectrically reinforced formed metal antenna element associated with one embodiment of the inventive concepts disclosed herein.

Referring now to FIG. 7, a diagram of internal components of a dielectrically reinforced formed metal antenna element associated with one embodiment of the inventive concepts disclosed herein is shown. The internal view 700 may indicate details of the dielectrically reinforced formed metal antenna element 110.

To conduct RF energy to the formed metal antenna element 410, the PCB 350 may include a left PCB transmission line 354 and right PCB transmission line 356 routed on a backplane 352 of the PCB 350. Each transmission line 354 356 may be electrically coupled with a corresponding left PCB via 344 and a right PCB via 346.

To electrically couple the dielectrically reinforced formed metal antenna element 110 to the PCB vias 344 346, the dielectrically reinforced formed metal antenna element 110 may employ a conductive elastomer 334 336 coupled with the PCB 350. The conductive elastomer 334 336 may be aligned with and configured to electrically couple each connection element 134 136 of the formed metal antenna element 410 to the respective PCB via 344 346. In turn the PCB vias 344 346 may function to couple the conductive elastomer 334 336 with each PCB transmission line 354 356.

The conductive elastomer 334 336 may maintain an additional function to physically separate the dielectric material 210 from the PCB 350 creating a flexible gap 850 (FIG. 8) between the dielectric material and the PCB 350.

The conductive elastomer may include a plurality of substances and methods for 1) conduction between each PCB via 344 346 and the connection elements 134 136, 2) maintenance of the flexible gap 850, and 3) an ability to flex during slight movement between the PCB 350 and the dielectrically reinforced formed metal antenna element 110 to ensure continuous connectivity of the RF path. Contemplated herein, a flexible conductor, a compression-fit electrical connector, a spring-loaded conductor, a solder-less option such as a surface-mount, pick-and-placeable, and a solder reflow compatible connector may function within the scope of the conductive elastomers 344 346.

The mechanical couples 112 may function to removably couple the dielectrically reinforced formed metal antenna element 110 to the PCB 350. In one embodiment, the mechanical couples 112 may function as barbs which may click into each PCB mechanical coupling orifice 412 holding the dielectric material 210 firmly yet flexibly in place proximal with the PCB 350.

FIG. 8

Figure 8:
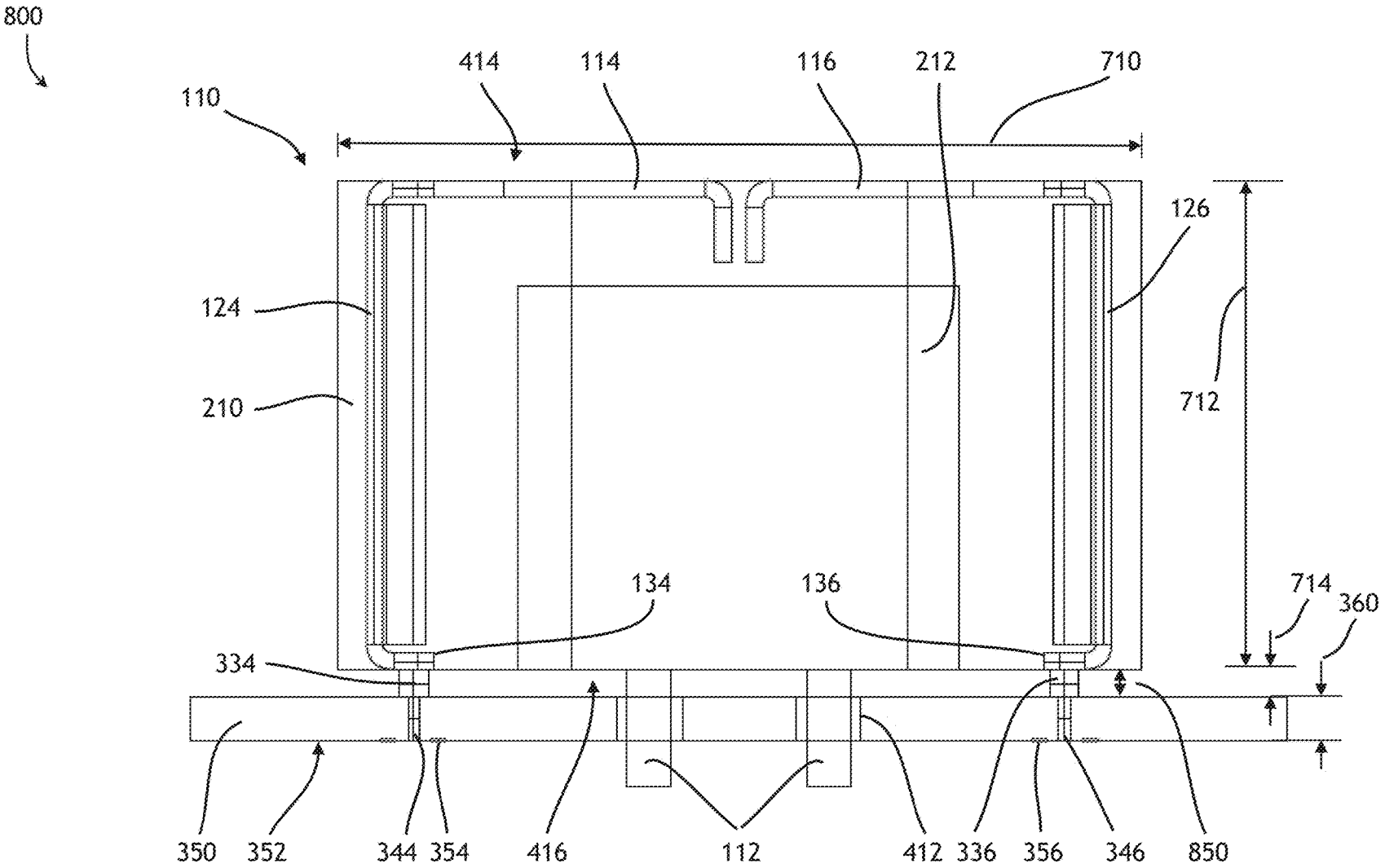
FIG. 8 is a diagram of a front view of a dielectrically reinforced formed metal antenna element exemplary of one embodiment of the inventive concepts disclosed herein.

Referring now to FIG. 8, a diagram of a front view of a dielectrically reinforced formed metal antenna element exemplary of one embodiment of the inventive concepts disclosed herein is shown. A front view 800 may indicate specific detail of a dimension of the dielectrically reinforced formed metal antenna element 110. Each conductive elastomer 334 336 may provide for the flexible gap 850 which may maintain an exemplary height of gap 714 of approximately 0.1 inches.

The dielectrically reinforced formed metal antenna element 110 may maintain an exemplary width of element 710 of approximately 0.75 inches to accommodate a width of the formed metal antenna element 410. Where the dielectric material 210 may be greater in width than the formed metal antenna element 410, the overall width of the dielectrically reinforced formed metal antenna element 110 may enable precise placement of the plurality of dielectrically reinforced formed metal antenna element 110 on the PCB 350.

An exemplary height of the formed metal antenna element 410 may be approximately 0.45 inches and be dependent on multiple factors including a desired frequency, a desired wavelength, and a desired bandwidth of the transmission and reception of the dielectrically reinforced formed metal antenna element 110. Compared to a PCB thickness 360, the height of the element 712 may maintain a large aspect ratio to the PCB thickness 360 where a greater aspect ratio may correspond to a greater bandwidth capability. Here, the greater height of the element 712 may enable a transmission and a reception of a bandwidth over a specific frequency range capability of the dielectrically reinforced formed metal antenna element 110. In one embodiment of the inventive concepts disclosed herein, the specific frequency range includes a range from VHF to SHF including 100 MHz to 20 GHz.

FIG. 9

Figure 9:
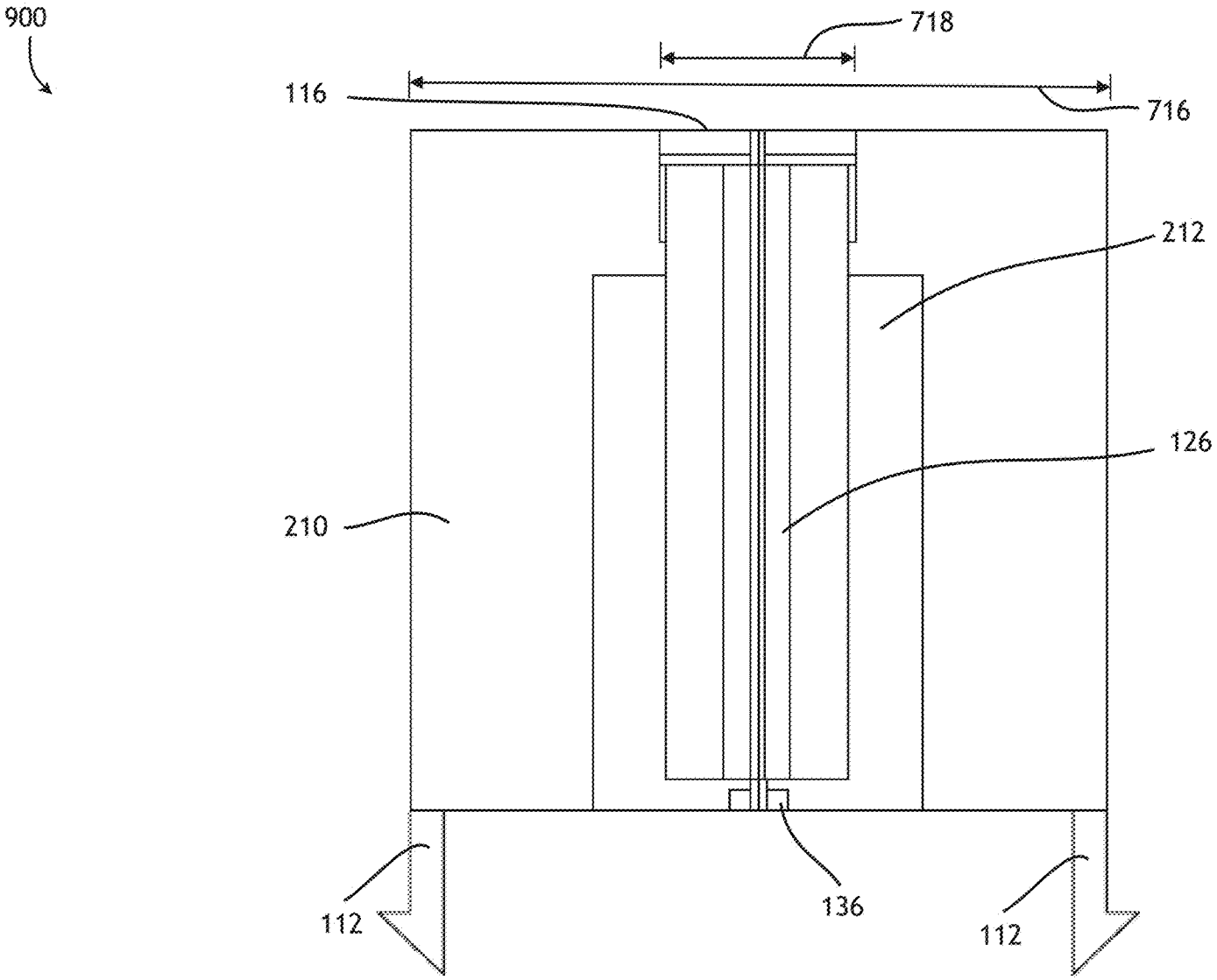
FIG. 9 is a diagram of a side view of a dielectrically reinforced formed metal antenna element exemplary of one embodiment of the inventive concepts disclosed herein.

Referring now to FIG. 9, a diagram of a side view of a dielectrically reinforced formed metal antenna element exemplary of one embodiment of the inventive concepts disclosed herein is shown. A side view 900 may offer depth details of the dielectrically reinforced formed metal antenna element 110. A depth 716 of the dielectrically reinforced metal antenna element 110 may indicate a depth dimension of the dielectric material 210. Here, an exemplary depth of approximately 0.425 inches may offer an efficient balance between element size and desired performance. A depth 718 of the formed metal antenna element 410 may indicate a size of the radiating elements 114 116 and their ability to transmit and receive RF energy. Here, an exemplary depth 718 of the radiating elements may be approximately 0.12 inches offering a level of capability to the individual element 110 as well as a cooperative level of performance to the array 102.

FIG. 10

Figure 10:
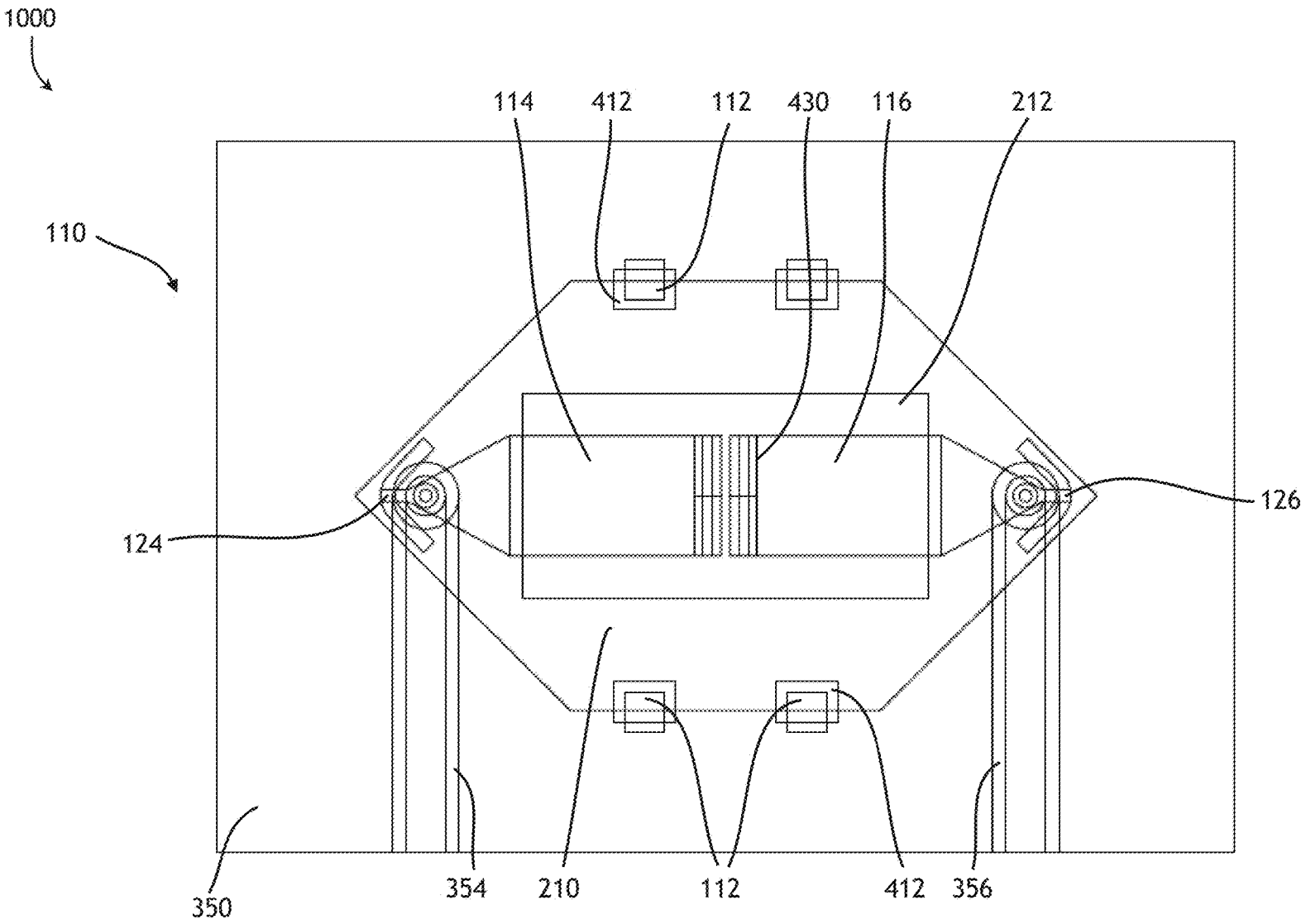
FIG. 10 is a diagram of a top view of a dielectrically reinforced formed metal antenna element associated with one embodiment of the inventive concepts disclosed herein.

Referring now to FIG. 10, a diagram of a top view of a dielectrically reinforced formed metal antenna element associated with one embodiment of the inventive concepts disclosed herein is shown. A top view 1000 of the dielectrically reinforced formed metal antenna element 110 may indicate top down details of the individual elements. The radiating elements 114 116 may each maintain an exemplary area of approximately 0.03 square inches enabling specific performance to the individual formed metal antenna element 410.

FIG. 11

Figure 11:
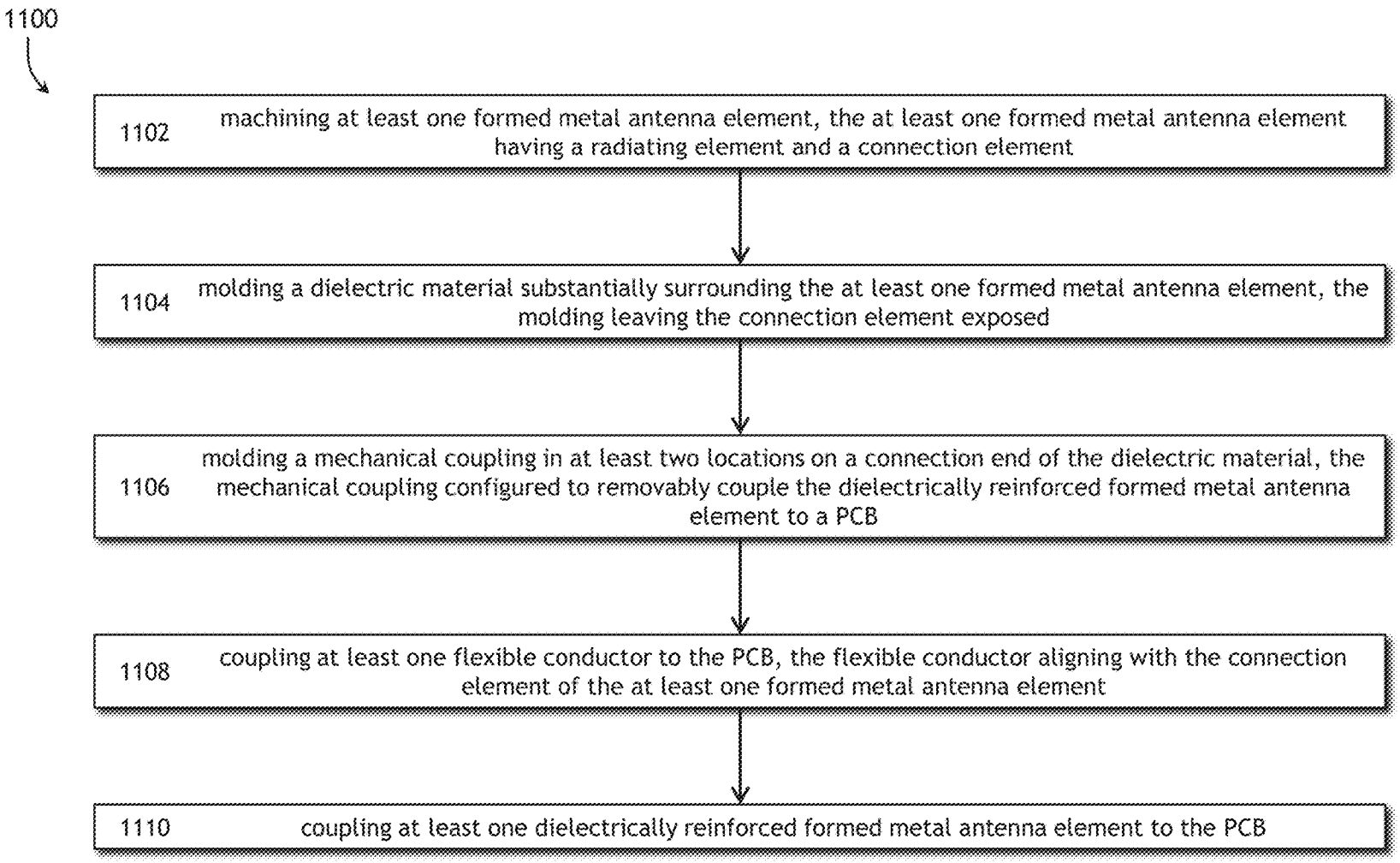
FIG. 11 is a diagram of method flow for fabrication of a dielectrically reinforced formed metal antenna element in accordance with one embodiment of the inventive concepts disclosed herein.

Referring now to FIG. 11, a diagram of method flow for fabrication of a dielectrically reinforced formed metal antenna element in accordance with one embodiment of the inventive concepts disclosed herein is shown. A method 1100 for fabricating a dielectrically reinforced formed metal antenna element may include, at a step 1102, machining a formed metal antenna element, the formed metal antenna element having a radiating element and a connection element. A step 1104 may include molding a dielectric material substantially surrounding the formed metal antenna element, the molding leaving the connection element exposed. A step 1106 may include molding a mechanical coupling in at least two locations on a connection end of the dielectric material, the mechanical coupling configured to removably couple the dielectrically reinforced formed metal antenna element to a PCB.

A step 1108 may include coupling at least one flexible conductor to the PCB, the flexible conductor aligning with each of the connection elements of the formed metal antenna element and a step 1110 may include coupling at least one dielectrically reinforced formed metal antenna element to the PCB.

CONCLUSION

As will be appreciated from the above description, embodiments of the inventive concepts disclosed herein may provide a novel solution to bandwidth limits at lower frequencies by implementing a dielectrically reinforced formed metal antenna element capable of a great frequency range offering extended bandwidth unlimited by geometry and easily interchangeable.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objectives and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. A dielectrically reinforced formed metal antenna element, comprising:

at least one formed metal antenna element electrically connectable with a printed circuit board (PCB), the at least one formed metal antenna element having a radiating element at a radiating end of the at least one formed metal antenna element and a connection element at a connection end of the at least one formed metal antenna element, the at least one formed metal antenna element maintaining a height above the PCB enabling a transmission and a reception of a bandwidth over a specific frequency range;

a dielectric material surrounding a substantial portion of the at least one formed metal antenna element allowing the connection element to remain exposed, the dielectric material including a cavity situated in a center section of the dielectric material proximal with the at least one formed metal antenna element, the cavity open to and extending to a coupling end of the dielectrically reinforced formed metal antenna element proximal with the connection end of the at least one formed metal antenna element;

a mechanical couple affixed to the dielectric material proximal with the PCB, the mechanical couple configured to removably couple the dielectrically reinforced formed metal antenna element to the PCB;

a conductive elastomer coupled with the PCB, the conductive elastomer aligned with and configured to electrically couple the connection element of the at least one formed metal antenna element to the PCB, the conductive elastomer flexible and configured to separate the dielectric material from the PCB creating a flexible gap between the dielectric material and the PCB.

2. The dielectrically reinforced formed metal antenna element of claim 1, wherein the at least one formed metal antenna element further comprises an L-shaped dipole pair of equal and opposite metal antenna elements each electrically coupled with the PCB via the conductive elastomer.

3. The dielectrically reinforced formed metal antenna element of claim 1, wherein the at least one formed metal antenna element is comprised of one of: a copper alloy, a beryllium copper, a stainless steel, an aluminum, a nickel, a nickel alloy, a silver, and a spring steel.

4. The dielectrically reinforced formed metal antenna element of claim 1, wherein the at least one formed metal antenna element is photo etched at a bending line enabling a precise dimension.

5. The dielectrically reinforced formed metal antenna element of claim 1, wherein the height enabling the transmission and the reception of the frequency bandwidth is approximately 0.45 inches.

6. The dielectrically reinforced formed metal antenna element of claim 1, wherein the radiating element of the at least one formed metal antenna element is approximately 0.12 inches in width and maintains a thickness of approximately 0.05 inches.

7. The dielectrically reinforced formed metal antenna element of claim 1, wherein the specific frequency range includes a range from VHF to SHF including 100 MHz to 20 GHz.

8. The dielectrically reinforced formed metal antenna element of claim 1, wherein the dielectric material maintains a hexagonal shape enabling four of the dielectrically reinforced formed metal antenna elements to meet at 90-degree angles to form an octagonal outer perimeter parallel to the PCB.

9. The dielectrically reinforced formed metal antenna element of claim 1, wherein the dielectric material further comprises one of: a plastic, a ceramic, and a ceramic filled plastic and maintains a rigidity to maintain a shape of the at least one formed metal antenna element.

10. The dielectrically reinforced formed metal antenna element of claim 1, wherein the conductive elastomer is configured to 1) conduct between the at least one formed metal antenna element and the PCB, 2) maintain the flexible gap, and 3) flex during a slight movement between the PCB and the dielectric material.

11. The dielectrically reinforced formed metal antenna element of claim 1, wherein the dielectrically reinforced formed metal antenna element is further configured to cooperate with a plurality of the dielectrically reinforced formed metal antenna element to form an array.

12. The dielectrically reinforced formed metal antenna element of claim 11, wherein the array and the PCB are conformal.

13. A method for fabricating a dielectrically reinforced formed metal antenna element, comprising:

machining at least one formed metal antenna element, the at least one formed metal antenna element having a radiating element and a connection element;

molding a dielectric material substantially surrounding the at least one formed metal antenna element, the molding leaving the connection element exposed;

molding a mechanical coupling in at least two locations on a connection end of the dielectric material, the mechanical coupling configured to removably couple the dielectrically reinforced formed metal antenna element to a PCB;

coupling at least one flexible conductor to the PCB, the flexible conductor aligning with the connection element of the at least one formed metal antenna element; and coupling at least one dielectrically reinforced formed metal antenna element to the PCB.

14. The method for fabricating a dielectrically reinforced formed metal antenna element of claim 13, wherein machining the at least one formed metal antenna element further comprises photo etching the at least one formed metal antenna element at a bending line enabling a precise dimension.

15. The method for fabricating a dielectrically reinforced formed metal antenna element of claim 13, wherein molding the dielectric material further comprises one of: a three-dimensional printing and an injection molding.

* * * * *